US009506300B2

(12) United States Patent
Leuchtenberg et al.

(10) Patent No.: US 9,506,300 B2
(45) Date of Patent: Nov. 29, 2016

(54) SLIP JOINT AND METHOD OF OPERATING A SLIP JOINT

(75) Inventors: Christian Leuchtenberg, Singapore (SG); Alexander John Macgregor, Scotland (GB)

(73) Assignee: MANAGED PRESSURE OPERATIONS PTE LTD., Singapore (SG)

( * ) Notice: Subject to any disclaimer, the term of this patent is extended or adjusted under 35 U.S.C. 154(b) by 60 days.

(21) Appl. No.: 14/112,868

(22) PCT Filed: Apr. 20, 2012

(86) PCT No.: PCT/GB2012/050863

§ 371 (c)(1),
(2), (4) Date: Jan. 24, 2014

(87) PCT Pub. No.: WO2012/143723

PCT Pub. Date: Oct. 26, 2012

(65) Prior Publication Data

US 2014/0138096 A1 May 22, 2014

(30) Foreign Application Priority Data

Apr. 21, 2011 (GB) ..... 1106718.8

(51) Int. Cl.

| | |
|---|---|
| ***F16L 35/00*** | (2006.01) |
| ***F16J 15/18*** | (2006.01) |
| ***E21B 33/04*** | (2006.01) |
| ***F16J 15/48*** | (2006.01) |
| ***F16L 17/00*** | (2006.01) |
| ***E21B 7/128*** | (2006.01) |
| ***E21B 17/08*** | (2006.01) |
| ***E21B 17/07*** | (2006.01) |

(52) U.S. Cl.
CPC ..... *E21B 17/085* (2013.01); *E21B 17/07* (2013.01)

(58) Field of Classification Search
CPC ..... E21B 19/006
See application file for complete search history.

(56) References Cited

U.S. PATENT DOCUMENTS

| | | | | |
|---|---|---|---|---|
| 3,313,345 | A | 4/1967 | Fischer | |
| 3,675,713 | A | 7/1972 | Watkins | |
| 3,695,633 | A | 10/1972 | Hanes | |
| 3,910,110 | A | 10/1975 | Jefferies et al. | |
| 3,976,148 | A | 8/1976 | Maus et al. | |
| 4,078,832 | A * | 3/1978 | Wittman | F16L 37/002 277/621 |
| 4,282,939 | A | 8/1981 | Maus et al. | |
| 4,411,434 | A * | 10/1983 | Lewis | 277/322 |
| 4,440,239 | A | 4/1984 | Evans | |

(Continued)

FOREIGN PATENT DOCUMENTS

| | | |
|---|---|---|
| GB | 2 443 561 A | 5/2008 |
| WO | WO 2007/047800 A2 | 4/2007 |

*Primary Examiner* — Matthew R Buck
*Assistant Examiner* — Douglas S Wood
(74) *Attorney, Agent, or Firm* — Norman B. Thot

(57) ABSTRACT

A slip joint (10) having a tubular inner barrel (11*b*) and a tubular outer barrel (11*a*), the inner barrel (11*b*) lying at least partially within the outer barrel (11*a*), the slip joint further comprising a sealing assembly (12*a*), (12*b*), (12*c*) which is operable to provide a substantially fluid tight seal between two sealing surfaces comprising an interior surface of the outer barrel 11*a* and an exterior surface of the inner barrel (11*b*), the sealing assembly (12*a*), (12*b*), (12*c*) including an actuator (20) and a seal (46), the actuator (20) being movable to push the seal (46) into engagement with one of the sealing surfaces.

12 Claims, 2 Drawing Sheets

(56) References Cited

U.S. PATENT DOCUMENTS

Figure 1:
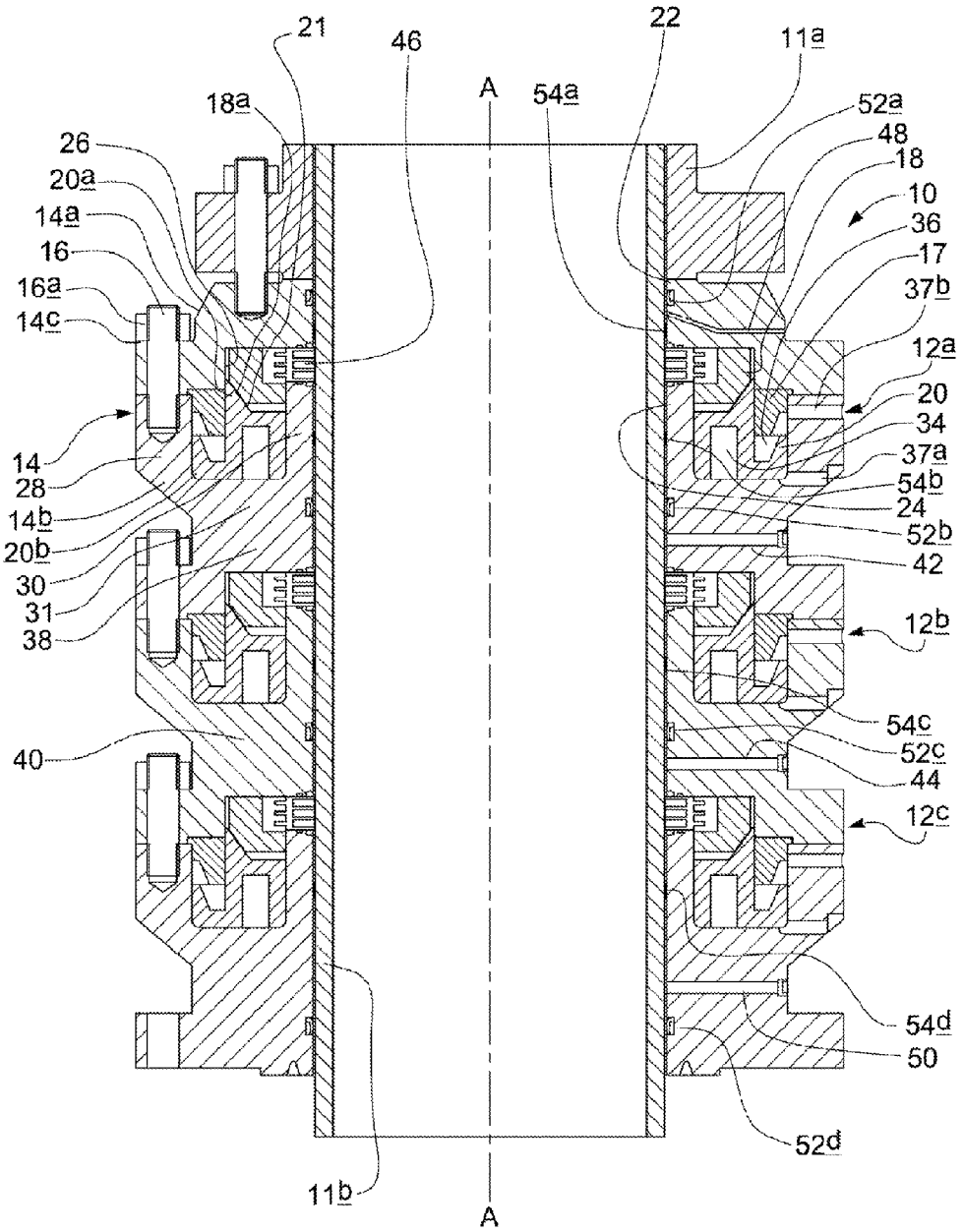

| | | | | |
|---|---|---|---|---|
| 4,469,017 | A * | 9/1984 | Hanlon | 92/168 |
| 4,527,425 | A | 7/1985 | Stockton | |
| 4,610,161 | A | 9/1986 | Gehrig et al. | |
| 4,626,135 | A | 12/1986 | Roche | |
| 5,168,932 | A | 12/1992 | Worrall et al. | |
| 5,205,165 | A | 4/1993 | Jardine et al. | |
| 2002/0074123 | A1 | 6/2002 | Regan | |
| 2007/0095540 | A1 | 5/2007 | Kozicz et al. | |
| 2008/0105434 | A1 | 5/2008 | Orbell et al. | |
| 2008/0210471 | A1 | 9/2008 | Bailey et al. | |
| 2009/0139724 | A1 | 6/2009 | Gray et al. | |

* cited by examiner

SLIP JOINT AND METHOD OF OPERATING A SLIP JOINT

The present invention relates to a slip joint and method of operating a slip joint, particularly but not exclusively to a slip joint for use in a riser of drilling system for offshore drilling, which permits fluid in the riser to be pressurised.

During drilling of a subsea wellbore, a riser is provided to return the drilling fluid (mud), cuttings and any other solids or fluids from the wellbore to the surface. The drill string extends down the centre of the riser, and the returning drilling fluid, cuttings etc flow along the annular space in the riser around the drill string (the riser annulus).

When drilling of the wellbore is carried out using a floating rig such as a drill ship, a semi-submersible, floating drilling or production platform, it is known to provide the riser with a slip joint which allows the riser to lengthen and shorten as the rig moves up and down as the sea level rises and falls with the tides and the waves. Such a slip joint is, for example, described in U.S. Pat. No. 4,626,135, and comprises an outer tube section which is connected to the wellhead, and an inner tube section which sits within the outer tube section and which is connected to the rig floor. Seals are provided between the outer and inner tube sections, and these substantially prevent leakage of fluid from the riser whilst allowing the inner tube section to slide relative to the outer tube section.

Conventional slip joints, such as the one disclosed in U.S. Pat. No. 4,626,135, are not designed to retain significant pressure in the riser. Drilling methods, such as managed pressure drilling or mud cap drilling, which involve the pressurisation of fluid in the wellbore annulus are becoming increasingly important, and these require the ability to contain fluid pressure in the riser annulus during drilling.

A prior art example of a slip joint which is specifically designed to operate at much higher operating pressures is disclosed in US 2003/0111799.

The present invention relates to an alternative configuration of high pressure slip joint.

According to the first aspect of the invention we provide a slip joint having a tubular inner barrel and a tubular outer barrel, the inner barrel lying at least partially within the outer barrel, the slip joint further comprising a sealing assembly which is operable to provide a substantially fluid tight seal between two sealing surfaces comprising an interior surface of the outer barrel and an exterior surface of the inner barrel, the sealing assembly including an actuator and a seal, the actuator being movable to push the seal into engagement with one of the sealing surfaces.

The actuator may comprise a piston which is located in a chamber in a slip joint housing, the piston being movable in response to fluid pressure in the chamber, to push the seal into engagement with one of the sealing surfaces.

In this case, the sealing assembly may further comprise an annular packing element which is mounted with the piston in the housing and which is arranged radially outwardly of the seal, the piston in use engaging with the annular packing element so that movement of the actuator to push the seal into engagement with one of the sealing surfaces causes the annular packing element to constrict around the seal. Preferably, the annular packing element is caused to constrict around the seal by virtue engagement of the annular packing element with the housing.

The piston may be movable generally parallel to a longitudinal axis of the inner and outer barrels to push the seal into engagement with one of the sealing surfaces.

In one embodiment of the invention, the actuator is movable to push the seal into engagement with the exterior surface of the inner barrel. In this case, the actuator may be mounted in a housing on the outer barrel.

The slip joint may include two sealing assemblies displaced with respect to one another generally parallel to a longitudinal axis of the inner and outer barrels, both of which are operable to provide a substantially fluid tight seal between two sealing surfaces comprising an interior surface of the outer barrel and an exterior surface of the inner barrel. In this case, the sealing assemblies are preferably mounted in a housing on the outer barrel, there being a fluid flow passage in the housing which provides fluid communication between the exterior of the housing and the space between the inner and outer barrels and between the two seals.

The slip joint may include three sealing assemblies displaced with respect to one another generally parallel to a longitudinal axis of the inner and outer barrels, each of which are operable to provide a substantially fluid tight seal between two sealing surfaces comprising an interior surface of the outer barrel and an exterior surface of the inner barrel. In this case, the sealing assemblies are preferably mounted in a housing on the outer barrel, there being two fluid flow passages in the housing the first one of which provides fluid communication between the exterior of the housing and the space between the inner and outer barrels and between the two seals of the first and second sealing assemblies, and the second one of which provides fluid communication between the exterior of the housing and the space between the inner and outer barrels and between the two seals of the second and third sealing assemblies.

According to a second aspect of the invention we provide a method of operating a slip joint according to the first aspect of the invention, where provided with two sealing assemblies and one fluid flow passage, wherein the method comprises supplying fluid to the fluid flow passage at a pressure which is between the pressure of fluid inside the slip joint and the pressure of fluid outside the slip joint.

The three sealing assemblies may be arranged in the order of first sealing assembly, second sealing assembly and third sealing assembly when travelling in the direction along the longitudinal axis of the slip joint towards the end of the outer barrel.

According to a third aspect of the invention we provide a method of operating a slip joint according to the first aspect of the invention where provided with three sealing assemblies and two fluid flow passages, wherein the method comprises supplying fluid to the first fluid flow passage at a pressure which is between the pressure of fluid inside the slip joint and the pressure of fluid outside the slip joint, and supplying fluid to the second fluid flow passage at a pressure which is less than the pressure of fluid in the first fluid flow passage, and greater than the pressure outside the slip joint.

Alternatively, the method may comprise supplying fluid to the second flow passage at a pressure which is greater than the pressure inside the riser. In this case, the method may further comprise supplying fluid to the first flow passage at a pressure which is greater than the pressure inside the riser but less than the pressure at the second flow passage.

Figure 2:
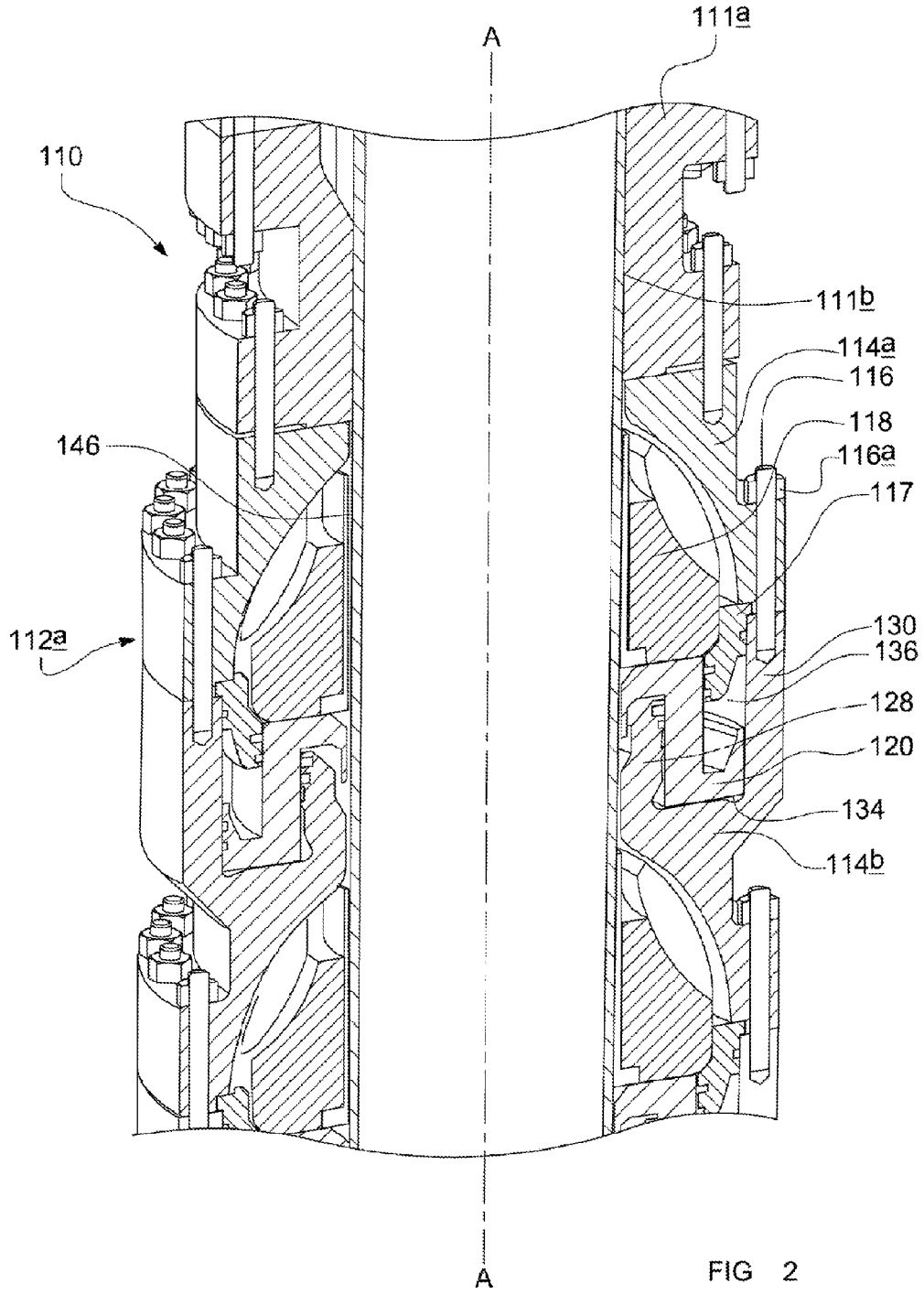

Embodiments of the invention will be described, by way of example only, with reference to the accompanying figures, of which FIG. 1 shows a longitudinal cross-section through a first embodiment of riser slip joint according to the invention, FIG. 2 shows a longitudinal cross-section through a second embodiment of riser slip joint according to the invention.

Referring now to FIG. 1, there is shown a riser slip joint 10 comprising an outer barrel 11*a*, an inner barrel 11*b*, and three sealing assemblies 12*a*, 12*b*, 12*c*. For clarity, only the elements of the first sealing assembly 12*a* are specifically described and numbered, and it should be appreciated that, in this example of slip joint, the second 12*b* and third 12*c* sealing assemblies are identical.

The sealing assembly 12*a* comprises a housing 14 which is divided into a first part 14*a* and a second part 14*b* which are fastened together using a plurality of fasteners 16. In this example, conventional stud and nut fasteners are used. Alternatively, in order to maximise the packing of the fasteners around the housing 14, nuts which are not tightened by external flats like the conventional nuts, but which are taller and which are provided with a drive hole (square/hexagonal or the like) in the top of the nut may be used, so that a tool for tightening the nut may be attached directly to the top of the nut. Cap head screws or bolts may be used instead, however.

The first part 14*a* of the housing 14 is connected to the outer barrel 11*a*, whilst the inner barrel 11*b* extends along a central passage through the housing 14.

The exterior surface of each housing part 14*a*, 14*b* is generally cylindrical, but the first housing part 14*a* is provided with a shoulder 14*c* which extends generally perpendicular to the longitudinal axis A of the slip joint 10 between a smaller outer diameter portion and a larger outer diameter portion, the larger outer diameter portion being between the smaller outer diameter portion and the second part 14*b* of the housing 14. The outer diameter of the second part 14*b* of the housing 14 is approximately the same as the outer diameter of the larger outer diameter portion of the first part 14*a* of the housing 14.

A plurality of generally cylindrical fastener receiving passages ("bolt holes") are provided in the housing 14, and in this embodiment of the invention, these extend generally parallel to the longitudinal axis A of the slip joint 10 from the shoulder 14*c* through the larger outer diameter portion of the first part 14*a* of the housing 14 into an outer wall 28 of the second part 14*b* of the housing 14. Preferably the portion of each bolt hole in the second part 14*b* of the housing 14 is threaded, so that the two parts 14*a*, 14*b* of the housing 14 may be secured together by passing a stud 16 through each of these bolt holes so that a threaded shank of each stud 16 engages with the threaded portion of the bolt hole whilst a nut 16*a* mounted on the free end of the stud 16 engages with the shoulder 14*c*.

In order to ensure that the housing 14 is substantially fluid tight, in a preferred embodiment of the invention, a sealing device is provided between the first part 14*a* and the second part 14*b* of the housing 14. This sealing device may comprise an O-ring or the like located between the adjacent end faces of the two parts 14*a*, 14*b* of the housing 14, the end faces extending generally perpendicular to the longitudinal axis A of the slip joint 10. This means that the sealing device is crushed between the two parts 14*a*, 14*b* of the housing 14 as the bolts 16 are tightened. Obtaining a good seal between the two parts 14*a*, 14*b* of the housing 14 would, however, rely on the interface being free from damage or particulate contaminates, and the crushing of the sealing device could result in damage to the sealing device. As such, in the preferred embodiment of the invention, illustrated in FIG. 1, the sealing device comprises a sealing ring 17 which engages with the interior face of the housing 14, extending between the first and second parts 14*a*, 14*b*. By locating the seal device in this position, the sealing device is not subjected to loading from the bolts 16 as the bolts 16 are tightened, and installation of this configuration of sealing device is more straightforward.

An annular packing element 18 is housed in the first part 14*a* of the housing 14, and a hydraulic actuating piston 20 is housed in the second part 14*b* of housing 14. Circular axial ports 22, 24 are provided in the first 14*a* and second 14*b* parts of the housing 14 respectively, the first part 14*a* of the housing 14 including an enlarged cylindrical bore 26 which extends from the port 22 to the second part 14*b* of the housing 14.

The second part 14*b* of the housing 14 includes a generally cylindrical outer wall 28, and a generally coaxial, cylindrical inner wall 30, connected by a base part 31. The piston 20 is located in the annular space between the outer wall 28 and the inner wall 30, and engages with each of the outer wall 28 and inner wall 30 so that the piston 20 divides this annular space into two chambers, and prevents any substantial leakage of fluid round the piston 20 from one chamber to the other.

In this example, the piston 20 has a generally cylindrical body 20*a* which engages with or is very close to the inner wall 30 but which is spaced from the outer wall 28. At a lowermost end of the piston 20 (the end which is furthest from the packing element 18), there is provided a sealing part 20*b* which extends from the lowermost end of the piston body 20*a* to the inner wall 30, The sealing ring 17 is also in sealing engagement with the uppermost end of the piston body 20*a* (the end which is closest to the packing element 18). A first fluid tight chamber 34 is therefore formed between the outer wall 28, inner wall 30, base part 31 and the sealing part 20*b* of the piston 20, and a second fluid tight chamber 36 is formed between the outer wall 28, the sealing device 17 and the sealing part 20*b* and the body 20*a* of the piston 20.

In this embodiment of the invention, the uppermost end of the piston body 20*a* is provided with a cam surface 21 which extends at around 45° to the longitudinal axis A of the slip joint 10, facing towards the outer barrel 11*a* of the riser. The cam surface 21 engages with a correspondingly angled cam surface 18*a* on the packing element 18.

The piston 20 is movable between a rest position in which the volume of the first chamber 34 is minimum, and an active position in which the cam surface 21 and the uppermost end of the piston 20 extend into the first part 14*a* of the housing 14.

A first control passage 37*a* is provided through the second part 14*b* of the housing 14 to connect the first chamber 34 with the exterior of the housing 14, and, in this embodiment of the invention, a second control passage 37*b* is provided through the second part 14*b* of the housing 14 to connect the second chamber 36 with the exterior of the housing 14. The piston 20 may thus be moved to the active position towards the packing element 18 by the supply of pressurised fluid through the first control passage 37*a*, and to the rest position away from the packing element 18 by the supply of pressurised fluid through the second control passage 37*b*. It should be appreciated, however, that in an alternative design, only one control passage may be provided if there is an alternative means (such as a spring) to return the piston 20 to its original position following release of fluid pressure from the one control passage.

The piston 20 is arranged such that when it is in the rest position, it does not exert any forces on the packing element 18, whereas when it is in the active position, it pushes the cam surface 21 against the packing element 18, which, in turn, pushes the packing element 18 radially inwardly towards the inner barrel 11*b*.

The packing element 18 is made from an elastomeric material, typically a rubber. The packing element 18 may include metallic inserts or ribs to assist in maintaining its structural integrity, but this is not essential, and inserts are not provided in a preferred embodiment of the invention. The action of the piston 20 forcing the packing element 18 against the cam surface causes the packing element 18 to be compressed, and to constrict, like a sphincter, reducing the diameter of its central aperture. An annular sealing part 46 is provided between the packing element 18 and the inner barrel 11*b* constriction of the packing element 18 pushing the sealing part 46 against the inner barrel 11*b* to form a substantially fluid tight seal. The sealing part 46 thus acts to prevent flow of fluid from inside the outer barrel 11*a* of the slip joint 10 to the outside of the inner barrel 11*b*, and thus substantially prevents leakage of fluid from the slip joint 10. It will be appreciated that the integrity of the seal thus provided can be improved by increasing the pressure of the fluid supplied to the first control passage 37*a*, as this increases the force with which the piston 20 pushes the packing element 18 against the sealing part 46. In this way, the fluid pressure containable by the sealing assembly may be increased.

It will be appreciated, of course, that, in use, there is sliding movement of the outer barrel 11*a* with respect to the inner barrel 11*b* of the slip joint 10 as the floating structure to which the riser extends moves with the swell of the ocean. This movement is permitted even when the sealing part 46 is pushed against the inner barrel 11*b* as described above. It will also be appreciated, however, that this movement will cause wear of the sealing part 46 and the resulting frictional forces may also cause localised heating of the sealing part 46 and inner barrel 11*b*. The sealing part 46 is specifically designed to provide a good seal with reduced wear and frictional heating.

In a preferred embodiment of the invention, the sealing part is made from PTFE (polytetrafluoroethylene) or a PTFE based polymer. The sealing part 46 may, instead be made from a polymer/elastomer combination such as PTFE in combination with polyurethane or hydrogenated acrylonitrite-butadiene rubber (HNBR), or PTFE in combination with ultra-high molecular weight polyethylene and polyurethane. The elastomeric component and polymeric component may be fabricated as separate tubes and placed in mechanical engagement with one another, or they may be co-moulded to form a single part. The polymeric component may include a plurality of apertures, (preferably radially extending apertures), and the elastomeric component may be cast or moulded onto the polymeric component so that the elastomer extends into, and preferably substantially fills these apertures.

It should be appreciated that by virtue of using an actuator to actively push the sealing part 46 against the inner barrel 11*b* of the slip joint 10, wear of the sealing part 46 will not immediately affect the seal integrity, since, as the sealing part 46 wears, fluid pressure in the piston chamber 34 will push the piston 20 further up relative to the housing 14, and this will, in turn, push the sealing part 46 further towards the inner barrel 11*b*.

In a preferred embodiment of the invention, the seal assembly components including the piston 20, the packing element 18 and the sealing part 46, or at least the portions of these components which bear on and move relative to another component may be coated with a low friction coating, for example made from Xylan, as this may assist in reducing the fluid pressure required to actuate the sealing assembly (by minimising the frictional forces between the components) and enhancing its corrosion resistance.

Whilst fluid pressure across the slip joint may be retained using only one sealing assembly, as mentioned above, in preferred embodiments of the invention, the slip joint 10 comprises a plurality of (in this example three) sealing assemblies 12*a*, 12*b*, 12*c*, which are co-axially aligned about a single longitudinal axis A and displaced relative to one another generally parallel to this axis A. This means that, if one of the sealing assemblies 12*a*, 12*b*, 12*c* fails, there are still two sealing assemblies 12*a*, 12*b*, 12*c* maintaining the capability of the slip joint 10 to retain fluid pressure in a riser.

The second part 14*b* of the housing 14 of the top sealing assembly 12*a* is integrally formed with the first part of the housing of the middle sealing assembly 12*b* (thus forming a first combined housing part 38), and the second part of the housing of the middle sealing assembly 12*b* is integrally formed with the first part of the housing of the bottom sealing assembly 12*c* (thus forming a second combined housing part 40). The housings of each sealing assembly 12*a*, 12*b*, 12*c* thus form a continuous central passage which extends parallel to the longitudinal axis A of the slip joint 10 around the inner barrel 11*b* of the riser.

It should be appreciated that this integration of housing parts means that there are two shoulders in the exterior surface of the combined housing part 38, 40, the first of which extends between the second part 14*b* of the upper sealing assembly 12*a* and the smaller diameter portion of the first part 14*a* of the middle sealing assembly 12*b*, and the second of which extends between the second housing part of the middle sealing assembly and the smaller diameter portion of the first part of the lower sealing assembly 12*c*.

The housing parts of the sealing assemblies 12*a*, 12*b*, 92*c* are, in this example, all fastened together using nut and stud assemblies as described above in relation to the first sealing assembly 12*a*. The bolt holes for connecting the first combined housing part 38 to the second combined housing part 40 extend from the second shoulder in the first combined housing part 38 and into the outer wall of the second housing part of the middle sealing assembly 12*b*. The bolt holes for connecting the second combined housing part 40 to the second housing part of the lowermost sealing assembly 12*c* extend from the second shoulder in the second combined housing part 40 and into the outer wall of the second housing part of the lowermost sealing assembly 12*c*. The nuts thus engage with the second shoulder on each of the combined housing parts 38, 40.

In this embodiment of the invention, each of the three sealing assemblies is identical in construction and operation, although it will be appreciated that this need not be the case.

As each sealing assembly 12*a*, 12*b*, 12*c* is independently actuated, it is possible to choose how many sealing assemblies are activated when the slip joint is in use. For example, when the pressure in the riser is relatively low, say 200 psi or lower, the operator may choose to activate only the uppermost 12*a* and lowermost 12*c* sealing assemblies, with the middle sealing assembly 12*b* being kept as a spare for use only if one of the others fails.

Where the pressure in the riser is high, typically over 200 psi, it is preferably for all three sealing assemblies 12*a*, 12*b*, 12*c* to be used.

A first pressurisation flow passage 42 extends through the first combined housing part 38 into the cylindrical space enclosed by the housing 14 between the housing 14, the inner barrel 11*b* of the riser, the first sealing assembly 12*a* and the second sealing assembly 12*b*. A second pressurisation flow passage 44 extends through the second combined housing part 40 into the cylindrical space between the housing 14, the inner barrel 11*b* of the riser, the second sealing assembly 12*b* and the third sealing assembly 12*c*. The fluid in these flow passages 42, 44 may act as a lubricant to reduce wear of the sealing parts 46.

The provision of these pressurisation flow passages 42, 44 also means that is possible for the pressure to be dropped in stages across each seal assembly 12*a*, 12*b*, 12*c*. For example, if the fluid pressure in the riser is 900 psi, the first pressurisation flow passage 42 may be connected to fluid at 600 psi, and the second pressurisation flow passage 44 may be connected to fluid at 300 psi. The space between the lowermost 12*c* and middle 12*b* seal assemblies is thus pressurised to 300 psi, and the space between the middle 12*b* and uppermost seal assemblies is thus pressurised to 600 psi. This means that there is only a 300 psi pressure drop across each seal, and this may further reduce the wear on the seal and the likelihood of failure of the seal.

Alternatively, the second pressurisation flow passage 44 may be connected to fluid at a higher pressure than the riser pressure, so that clean lubricant is forced into the space between the housing 14 and the inner barrel 11*b* of the riser, i.e. to the seal contact zone. This may minimise the risk of drilling mud with solid contaminants entering the seal contact zone and adversely affecting the integrity of the seals. In this case, the first pressurisation flow passage 42 is advantageously connected to fluid at an intermediate pressure—lower than the pressure at the second pressurisation flow passage 44 but higher than the riser pressure. In this way, the pressure differential across the sealing part 46 of the uppermost sealing assembly 12*a* is minimised.

In this embodiment of the invention, a further passage, hereinafter referred to as lubricant scavenging port 48 is provided in the housing. In this example, it extends through the first part 14*a* of the housing 14 of the uppermost sealing assembly 12*a* from the exterior of the housing 14 to the space between the inner barrel 11*b* and the housing 14 above the uppermost sealing part 46. This passage can be used to monitor the leak rate from the slip joint 10 and for scavenging of lubricant or mud.

Yet another passage, hereinafter referred to as the pressure monitoring port 50, extends through the housing 14 from the exterior of the housing 14 to the space between the inner barrel 11*b* and the housing 14 below the lowermost sealing assembly 12*c*. This may be used for pressure monitoring of the riser bore.

In this example, wiper seals 52*a*, 52*b*, 52*c*, 52*d* are provided in circumferential grooves around the interior surface of the housing 14. A first wiper seal 52*a* is located above the lubricant scavenger port 48, a second wiper seal 52*b* is located above the first pressurisation flow passage 42, a third wiper seal 52*c* is located above the second pressurisation flow passage 44, and a fourth wiper seal 52*d* is located below the pressure monitoring port 50. Although not essential, the provision of such wiper seals 52*a*, 52*b*, 52*c*, 52*d* is advantageous to minimise the ingress of contaminants or floating debris into the slip joint 10. Preferably pressure balancing ports (not shown) are provided through the housing to provide a fluid flow path across each wiper seal 52*a*, 52*b*, 52*c*, 52*d*, so that the wiper seals 52*a*, 52*b*, 52*c*, 52*d* are in a pressure balanced configuration, i.e. so that there is no pressure differential across the seal.

Also in this embodiment of the invention, circumferential wear rings 54*a*, 54*b*, 54*c*, 54*d* are provided between the exterior of the inner barrel 11*b* and the interior of the housing 14. A first wear ring 54*a* is provided between the sealing part of the uppermost sealing assembly 12*a* and the lubricant scavenging port 48. A second wear ring 54*b* is provided between the sealing part of the uppermost sealing assembly 12*a* and the second wiper seal 52*b*. A third wear ring 54*c* is provided between the sealing part of the middle sealing assembly 12*b* and the third wiper seal 52*c*. A fourth wear ring 54*d* is provided between the sealing part of the lowermost sealing assembly 12*c* and pressure monitoring port 50.

The wear rings 54*a*, 54*b*, 54*c*, 54*d* are made from a low friction polymer, such as polyimide, PEEK, Torlon, PTFE or a material based on any of these polymers, and are provided to centralise the inner barrel 11*b* in the slip joint 10 and to transfer bending moment through the system.

An alternative design of slip joint is illustrated in FIG. 2. It will be appreciated that this designs shares many similarities with the design shown in FIG. 1 and described above, and, as such, the same reference numerals have been used to designate the equivalents parts, but with a "1" inserted before the numerals used in relation to FIG. 2. For brevity, only the significant differences between the two designs will be described below.

Main differences between the designs illustrated in FIG. 1 and FIG. 2 reside in the shape of the packing unit 118, piston 120 and first housing part 114*a*. The surfaces of the packing unit 118 and piston 120 which engage when the piston 120 is moved to the active position extend generally perpendicular to the longitudinal axis A of the slip joint 110. The interior surface of the first housing part 114*a* is curved, and the packing element 118 is provided with a similar curved portion, engagement of this curved portion of the packing element 118 with the curved portion of the first housing part 114*a* when the piston 120 moves to the active position, causing the packing element 118 to constrict and push the sealing part 146 into engagement with the inner barrel 111*b* of the slip joint 110.

The sealing part 146 is also configured differently, and is much longer and thinner (radially relative to the slip joint 110) than the sealing part 46 shown in FIG. 1.

The operation of this embodiment of slip joint 110 is, otherwise, identical to that described above in relation to FIG. 1.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A slip joint, comprising:

a tubular inner barrel;

a tubular outer barrel, the inner barrel lying at least partially within the outer barrel;

at least two sealing assemblies, each sealing assembly being operable to provide a substantially fluid tight seal between two sealing surfaces, the two sealing surfaces comprising an interior surface of the tubular outer barrel and an exterior surface of the tubular inner barrel, each sealing assembly including an actuator and a seal, the actuator being movable to push the seal into engagement with one of the sealing surfaces, the at least two sealing assemblies being displaced with respect to one another generally parallel to a longitudinal axis of the inner and outer tubular barrels, and mounted in a housing on the outer tubular barrel, wherein, a fluid flow passage is provided in the housing, the fluid flow passage providing a flow of a fluid from the exterior of the housing into the space between the inner and outer tubular barrels and between the two seals, the slip joint includes three sealing assemblies displaced with respect to one another generally parallel to a longitudinal axis of the inner and outer tubular barrels, each of the sealing assemblies being operable to provide a substantially fluid tight seal between two sealing surfaces comprising an interior surface of the outer tubular barrel and an exterior surface of the inner tubular barrel, and the sealing assemblies are mounted in a housing on the outer tubular barrel, there being a first fluid flow passage and a second fluid flow passage in the housing, the first fluid flow passage providing a first flow of the fluid between the exterior of the housing and into the space between the inner and outer tubular barrels and between the two seals of the first and second sealing assemblies, and the second fluid flow passage providing a second flow of the fluid between the exterior of the housing and into the space between the inner and outer tubular barrels and between the two seals of the second and third sealing assemblies.

2. The slip joint according to claim 1, wherein the actuator comprises a piston, said piston being located in a chamber in a slip joint housing, the piston being movable in response to fluid pressure in the chamber, to push the seal into engagement with one of two the sealing surfaces.

3. The slip joint according to claim 2, wherein the sealing assembly further comprises an annular packing element, said annular packing element being mounted with the piston in the housing and being arranged radially outwardly of the seal, the piston in use engaging with the annular packing element so that movement of the actuator to push the seal into engagement with one of two the sealing surfaces causes the annular packing element to constrict around the seal.

4. The slip joint according to claim 3, wherein the annular packing element is caused to constrict around the seal by virtue of engagement of the annular packing element with the housing.

5. The slip joint according to claim 2, wherein the piston may be movable generally parallel to a longitudinal axis of the inner and outer tubular barrels to push the seal into engagement with one of the sealing surfaces.

6. The slip joint according to claim 1, wherein the actuator is movable to push the seal into engagement with the exterior surface of the inner barrel.

7. The slip joint according to claim 6, wherein the actuator is mounted in a housing on the outer tubular barrel.

8. The slip joint according to claim 1, wherein the sealing assemblies are arranged in the order of first sealing assembly, second sealing assembly and third sealing assembly when travelling in the direction along the longitudinal axis of the slip joint towards the end of the outer tubular barrel.

9. A method of operating the slip joint according to claim 1, wherein the method comprises the step of supplying the fluid to the fluid flow passage at a pressure which is between the pressure of fluid inside the slip joint and the pressure of fluid outside the slip joint.

10. A method of operating the slip joint according to claim 1, wherein the method comprises the steps of:

supplying the fluid to the first fluid flow passage at a pressure which is between the pressure of the fluid inside the slip joint and the pressure of the fluid outside the slip joint; and supplying the fluid to the second fluid flow passage at a pressure which is less than the pressure of the fluid in the first fluid flow passage, and greater than the pressure outside the slip joint.

11. A method of operating the slip joint according to claim 1, wherein the method comprises the step of supplying the fluid to the second flow passage at a pressure which is greater than the pressure inside a riser.

12. The method of operating the slip joint according to claim 10, wherein the method further comprises the step of supplying the fluid to the first flow passage at a pressure which is greater than the pressure inside a riser but less than the pressure at the second flow passage.

* * * * *